United States Patent [19]

Okutsu et al.

[11] Patent Number: 5,004,670

[45] Date of Patent: Apr. 2, 1991

[54] HIGH-CONTRAST DEVELOPMENT PROCESS FOR SILVER HALIDE PHOTOGRAPHIC MATERIAL

[75] Inventors: Eiichi Okutsu; Mitsunori Hirano; Morio Yagihara, all of Kanagawa, Japan

[73] Assignee: Fuji Photo Film Co., Ltd., Kanagawa, Japan

[21] Appl. No.: 306,422

[22] Filed: Feb. 6, 1989

[30] Foreign Application Priority Data

| | | | |
|---|---|---|---|
| Feb. 5, 1988 | [JP] | Japan | 63-25484 |
| Feb. 10, 1988 | [JP] | Japan | 63-29622 |
| Feb. 23, 1988 | [JP] | Japan | 63-40480 |

[51] Int. Cl.[5] ..... G03C 5/26; G03C 5/30

[52] U.S. Cl. ..... 430/265; 430/264; 430/268; 430/438; 430/486; 430/487; 430/490

[58] Field of Search ..... 430/264, 265, 267, 268, 430/438, 437, 486, 487, 490

[56] References Cited

U.S. PATENT DOCUMENTS

| | | | |
|---|---|---|---|
| 4,170,478 | 10/1979 | Case et al. | 430/490 |
| 4,269,929 | 5/1981 | Nothnagle | 430/264 |
| 4,298,673 | 11/1981 | Kubotera et al. | 430/487 |
| 4,429,036 | 1/1984 | Hirano et al. | 430/264 |
| 4,740,452 | 4/1988 | Okutsu et al. | 430/265 |
| 4,755,448 | 7/1988 | Katoh | 430/264 |
| 4,863,830 | 9/1989 | Okutsu et al. | 430/264 |

*Primary Examiner*—Richard L. Schilling
*Attorney, Agent, or Firm*—Sughrue, Mion, Zinn, Macpeak & Seas

[57] ABSTRACT

A high-contract development process is disclosed, which comprises developing a silver halide photographic material containing at least a hydrazine derivative with a developer having a pH of from 10.0 to 12.3 and containing (a) a dihydroxybenzene developing agent, (b) at least 0.3 mol/liter of a sulfite, and (c) at least one of compounds represented by formulae (I-1), (I-2), (I-3) or I-4);

(I-1)

wherein $R_1$, $R_2$, $R_3$, $R_4$, and $R_5$ each represents an alkyl group having from 1 to 5 carbon atoms or a hydroxyalkyl group, provided that $R_1$ and $R_2$, or $R_3$ $R_4$ may combine with each other to form a nitrogen-containing heterocyclic ring; and A and D each represents a substituted or unsubstituted alkylene group, (I-2)

wherein $R_6$, $R_7$, $R_8$, and $R_9$ each represents an alkyl group having from 1 to 5 carbon atoms or a hydroxyalkyl group, provided that $R_6$ and $R_7$, or $R_8$ and $R_9$ may combine with each other to form a nitrogen-containing heterocyclic ring, and E represents a substituted or unsubstituted alkylene group, (I-3)

wherein $R_{10}$ represents hydrogen atom, an unsubstituted alkyl group, or an alkyl group substituted by hydroxyl group, a halogen atom, an alkenyl group, an aryl group, an aryloxy group, a carbonamido group, a ureido group, a carboxyl group, a carbamoyl group, an acyl group, a sulfo group, a sulfonyl group, a sulfamoyl group, a cyano group, or a nitro group; $R_{11}$ represents a group which may have a substituent(s); and n represents and integer of from 0 to 3, and (I-4)

wherein $R_{12}$ and $R_{13}$ each represents a substituted or unsubstituted alkyl group, provided that at least one of $R_{12}$ and $R_{13}$ has hydroxyl group.

3 Claims, No Drawings

HIGH-CONTRAST DEVELOPMENT PROCESS FOR SILVER HALIDE PHOTOGRAPHIC MATERIAL

FIELD OF THE INVENTION

This invention relates to a high-contrast development process for silver halide photographic materials, and more particularly to a development process of increasing the contrast of silver halide photographic materials using hydrazine derivatives.

BACKGROUND OF THE INVENTION

It is known that photographic images having a very high contrast can be formed using a certain kind of silver halide and such a photographic image-forming process has been used in the field of photomechanical process.

For example, it is known that line images or dot images having a high contrast and a high blackened density, wherein imaged portions are clearly distinguished from non-imaged portions, are obtained by processing a lith-type silver halide photographic material containing silver chlorobromide (having a content of silver chloride of at least 50%) with a hydroquinone developer having a very lowered effective concentration (usually lower than 0.1 mol/liter) of sulfite ions. However, in the process, the developer is very unstable to air oxidation since the sulfite concentration in the developer is low and thus various efforts and attempts have been made for keeping stably the activity of the developer.

Thus, to solve the problem of instability of image forming by the aforesaid development process (i.e., lith development system), an image-forming system capable of giving very high contrast photographic characteristics by developing using a developer having a good storage stability has been desired and systems of forming a super high contrast negative photographic images having a $\gamma$ (gamma) value of over 10 by processing surface latent image-type silver halide photographic materials containing specific acylhydrazine compounds with a developer having a pH of from 11.0 to 12.3, containing at least 0.15 mol/liter of a sulfite preservative, and having good storage stability are proposed in, e.g., U.S. Pat. Nos. 4,166,742, 4,168,977, 4,221,857, 4,224,401, 4,243,739, 4,272,606, 4,311,781, 4,269,929, and 4,650,746. These new image-forming systems have a feature that even silver iodobromide or silver chloroiodobromide can be used in the system while in conventional super high contrast image-forming systems, only silver chlorobromide having a high silver chloride content can be used.

However, since in the process of using hydrazine derivatives, the pH of the developer is higher than that of an ordinary lith developer, there is a problem that the pH value is liable to deviate and the deviation of the pH value is liable to cause inconsistency in the result of photographic characteristics.

For solving the problem, U.S. Pat. No. 4,269,929 describes that the sensitizing and contrast increasing effects of hydrazine derivatives by a developer having a lower pH value are realized by adding an amino compound to an alkaline developer using a dihydroxybenzene developing agent and a 3-pyrazolidone developing agent as the developing agents to increase the activity of the developer.

However, even by the aforesaid means, it is impossible to reduce the pH value to such an extent of not causing the deviation under the ordinary storage or conditions for use.

Also, an amino compound functions as a solvent for silver halide (see, C. E. K. Mees, *The Theory of the Photographic Process*, 3rd Ed., page 370, and L. F. A. Mason, *Photographic Processing Chemistry*, page 43).

Thus, in the development process using a large amount of amino compound described in the aforesaid U.S. patent, a problem called as "silver stain" in the field of art is liable to occur. The silver stain means a fault that when in, for example, a process of processing a silver halide photographic material by an automatic processor and supplying a replenisher for the developer to the developer tank depending on the area of the photographic film processed, if the aforesaid developer is used for a long period of time, the silver halide eluted out from the photographic film processed deposits and attaches to the tank wall and rollers for conveying the film in the automatic processor as silver and the silver is transferred onto other photographic film to be separately processed.

For solving the problem of the silver stain, it is required to use a compound which has a function of increasing contrast and functions as a solvent for silver halide but no proper compounds from such a viewpoint have been known.

SUMMARY OF THE INVENTION

An object of this invention is, therefore, is to provide a development process giving photographic images having little or no silver stain in a process of forming negative photographic images of high contrast using a hydrazine derivative.

It has now been discovered that the aforesaid object can be attained by the present invention as set forth hereinbelow.

That is, according to this invention, there is provided a high-contrast development process for a silver halide photographic material containing at least one hydrazine derivative, which comprises processing the silver halide photographic material with a developer having a pH value of from 10.0 to 12.3 and containing (a) a dihydroxybenzene developing agent, (b) at least 0.3 mol/liter of a sulfite, and (c) at least one of compounds represented by formulae (I-1), (I-2), (I-3), or (I-4);

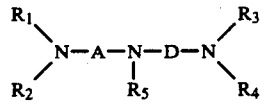

(I-1)

wherein $R_1$, $R_2$, $R_3$, $R_4$, and $R_5$ each represents an alkyl group having from 1 to 5 carbon atoms or a hydroxyalkyl group, provided that $R_1$ and $R_2$, or $R_3$ and $R_4$ may combine with each other to form a nitrogen-containing heterocyclic ring; and A and D each represents a substituted or unsubstituted alkylene group,

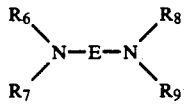

(I-2)

wherein $R_6$, $R_7$, $R_8$, and $R_9$ each represents an alkyl group having from 1 to 5 carbon atoms or a hydroxyalkyl group, provided that $R_6$ and $R_7$, or $R_8$ and $R_9$ may combine with each other to form a nitrogen-containing heterocyclic ring; and E represents a substituted or unsubstituted alkylene group, (I-3)

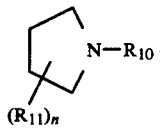

wherein $R_{10}$ represents hydrogen atom, an unsubstituted alkyl group, or an alkyl group substituted by hydroxyl group, a halogen atom, an alkenyl group, an aryl group, an aryloxy group, a carbonamido group, a ureido group, a carboxyl group, a carbamoyl group, an acyl group, a sulfo group, a sulfonyl group, a sulfamoyl group, a cyano group, or a nitro group; $R_{11}$ represents a group which may have a substituent(s); and n represents from 0 to 3, and (I-4)

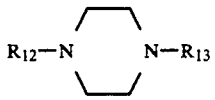

wherein $R_{12}$ and $R_{13}$ each represents a substituted or unsubstituted alkyl group, provided that at least one of $R_{12}$ and $R_{13}$ has hydroxyl group.

DETAILED DESCRIPTION OF THE INVENTION

Then, the invention is described in detail.

In the image-forming process of this invention, it is preferred to use a dihydroxybenzene developing agent as the developing agent and a p-aminophenol developing agent or a 1-phenyl-3-pyrazolidone developing agent as an auxiliary developing agent but as the case may be, the auxiliary developing agent may not be used.

As the dihydroxybenzene developing agent for use in this invention, there are hydroquinone, chlorohydroquinone, bromohydroquinone, isopropylhydroquinone, methylhydroquinone, 2,3-dichlorohydroquinone, 2,3-dibromohydroquinone, and 2,5-dimethylhydroquinone. Among them, hydroquinone is particularly preferred.

Examples of the 1-phenyl-3-pyrazolidone auxiliary developing agent are 1-phenyl-3-pyrazolidone, 1-phenyl-4,4-dimethyl-3-pyrazolidone, 1-phenyl-4-methyl4-hydroxymethyl-3-pyrazolidone, 1-phenyl-4,4-dihydroxy-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

Also, examples of the p-aminophenol auxiliary developing agent are N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol. Among them, N-methyl-p-aminophenol is preferred.

The dihydroxybenzene developing agent is preferably used in an amount of from 0.05 mol/liter to 0.8 mol/liter. Also, in the case of using a combination of the dihydroxybenzene developing agent and the p-aminophenol auxiliary developing agent or the p-aminophenol auxiliary developing agent, it is preferred that the former (i.e., the developing agent) is used in an amount of from 0.05 mol/liter to 0.5 mol/liter and the latter (i.e., the auxiliary developing agent) is used in an amount of not more than 0.06 mol/liter.

In this invention, the dihydroxybenzene developing agent may be used solely without using the auxiliary developing agent.

As the sulfite used as a preservative in this invention, there are sodium sulfite, potassium sulfite, lithium sulfite, sodium bisulfite, potassium metabisulfite, and formaldehyde sodium bisulfite.

The sulfite is used in an amount of at least 0.3 mol/liter but since if too much amount of the sulfite is used, it precipitates in the developer to stain the solution, it is preferred that the upper limit of the sulfite is 1.2 mols/liter.

Then, the amino compounds shown by formulae (I-1) and (I-2) described above are described in detail.

In formula (I-1), $R_1$, $R_2$, $R_3$, $R_4$, and $R_5$ each represents an alkyl group having from 1 to 5 carbon atoms (e.g., methyl, ethyl, propyl, butyl, isopropyl, t-butyl, t-amyl) or a hydroxyalkyl group (e.g., hydroxyethyl, hydroxypropyl, 2,3-dihydroxypropyl), and said $R_1$ and $R_2$, or said $R_3$ and $R_4$ may be combined with each other to form a nitrogen-containing heterocyclic ring (e.g., piperidino, piperazino, pyrrolidino, morpholino).

Also, in formula (I-1), A and D each represents a substituted or unsubstituted alkylene group (e.g., methylene, dimethylene, trimethylene, tetramethylene, propylene, dimethylethylene), with the alkylene groups having from 1 to 5 carbon atoms being preferred. Examples of the preferred substituent for the alkylene group are hydroxyl group and an alkoxy group.

$R_6$, $R_7$, $R_8$, and $R_9$ in formula (I-2) have the same significance as $R_1$, $R_2$, $R_3$, $R_4$, and $R_5$ in formula (I-1) and the nitrogen-containing heterocyclic ring formed by the combination of $R_6$ and $R_7$, or $R_8$ and $R_9$ has the same significance as the heterocyclic ring formed by the combination of $R_1$ and $R_2$, or $R_3$ and $R_4$ in formula (I-1). Also, E has the same significance as A or D in formula (I-1).

The amino compound shown by formula (I-1) or (I-2) is used in the range of preferably from 0.01 mol to 0.30 mol and particularly preferably from 0.01 mol to 0.20 mol per liter of the developer.

Then, specific examples of the amino compounds shown by formulae (I-1) and (I-2) are illustrated below but the invention is not limited to these compounds.

(I-1)-1

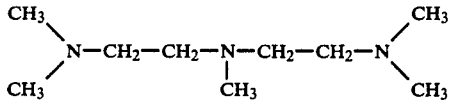

(I-1)-2

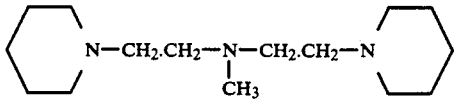

(I-1)-3

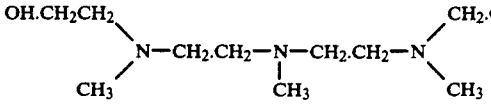

(I-1)-4

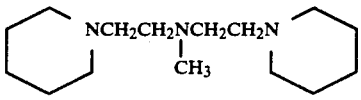

-continued

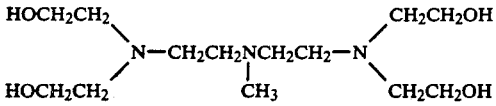
(I-1)-5

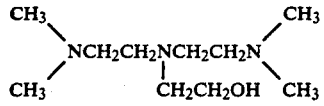
(I-1)-6

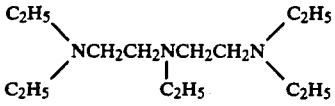
(I-1)-7

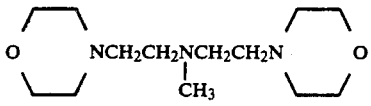
(I-1)-8

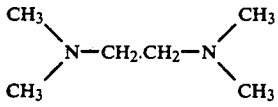
(I-2)-1

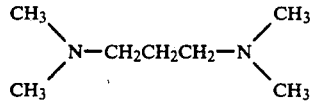
(I-2)-2

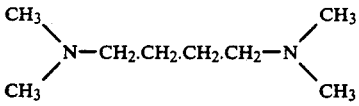
(I-2)-3

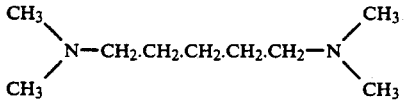
(I-2)-4

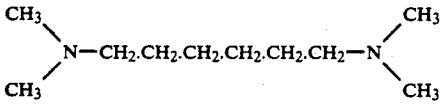
(I-2)-5

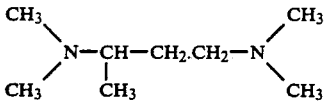
(I-2)-6

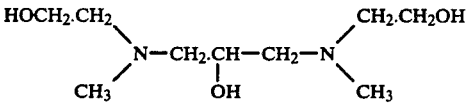
(I-2)-7

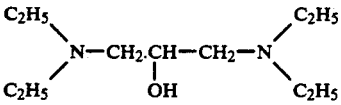
(I-2)-8

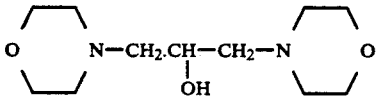
(I-2)-9

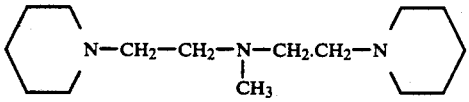
(I-2)-10

-continued

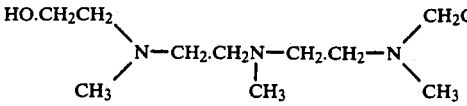
(I-2)-11

Then, the compounds shown by formula (I-3) described above are described in detail.

The alkyl group shown by $R_{10}$ in formula (I-3) is a straight chain, branched, or cyclic alkyl group having preferably from 1 to 10 carbon atoms and more preferably from 1 to 6 carbon atoms.

As the substituent for the substituted alkyl group shown by $R_{10}$, there are hydroxyl group, a halogen atom, an alkenyl group, an aryl group, an aryloxy group, a carbonamido group, a ureido group, a carboxyl group, a carbamoyl group, an acyl group, a sulfo group, a sulfonyl group, a sulfamoyl group, a cyano group, and a nitro group. When two or more substituents exist, they may be the same or different.

As the group which may have a substituent(s) shown by $R_{11}$, there are hydroxyl group, an alkyl group, an aryl group, an aryloxy group, an alkoxy group, a carbonamido group and a ureido group. When two or more substituents exist, they may be the same or different.

As the substituent for the substituted alkyl group shown by $R_{10}$, hydroxyl group is preferred and two or more hydroxyl groups may exist Also, at least one of the substituent of the substituted alkyl group shown by $R_{10}$ and the group shown by $R_{11}$ preferably has hydroxyl group as a substituent.

The amino compound shown by formula (I-3) is used in the range of preferably from 0.1 to 0.30 mol and more preferably from 0.01 to 0.20 mol per liter of the developer.

Then, specific examples of the compound shown by formula (I-3) are illustrated below but the invention is not limited to them.

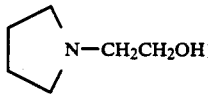
(I-3)-1

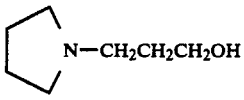
(I-3)-2

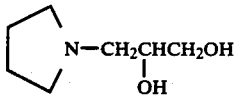
(I-3)-3

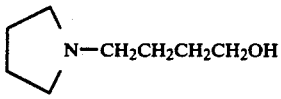
(I-3)-4

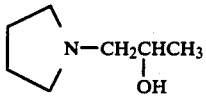
(I-3)-5

-continued (I-3)-6

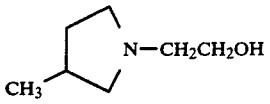

(I-3)-7

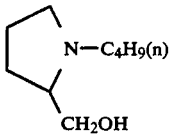

(I-3)-8

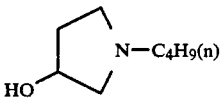

(I-3)-9

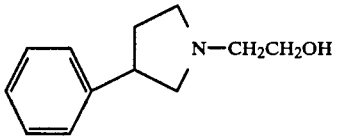

(I-3)-10

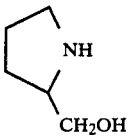

(I-3)-11

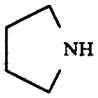

(I-3)-12

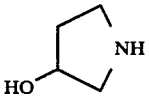

(I-3)-13

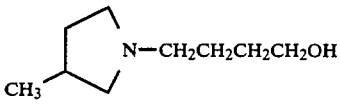

(I-3)-14

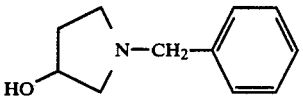

(I-3)-15

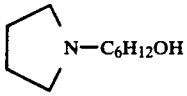

(I-3)-16

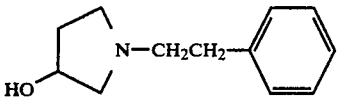

(I-3)-17

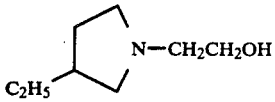

-continued (I-3)-18

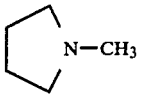

(I-3)-19

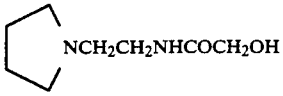

(I-3)-20

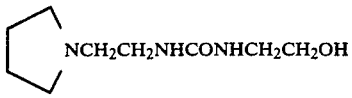

Then, the compounds shown by formula (I-4) described above are explained in detail.

In formula (I-4), $R_{12}$ and $R_{13}$ each represents a substituted or unsubstituted alkyl group and at least one of $R_{12}$ and $R_{13}$ has hydroxyl group.

The alkyl group is a straight chain, branched or cyclic alkyl group having preferably from 1 to 10 carbon atoms and more preferably from 1 to 6 carbon atoms.

As other substituents than hydroxyl group for the substituted alkyl group, there are a halogen atom, an alkenyl group, an aryl group, an alkoxy group, an arylthio group, a carbonamido group, a ureido group, a carboxyl group, a carbamoyl group, an acyl group, a sulfo group, a sulfonyl group, a sulfamoyl group, a cyano group, and a nitro group. Among these substituents, an alkenyl group, an aryl group, an alkoxy group, an aryloxy group, a carbonamido group, a ureido group, and a sulfonyl group are preferred.

When two or more substituents exist, they may be the same or different and also two or more hydroxyl groups may exist.

The compound shown by formula (I-4) is used in the range of preferably from 0.01 to 0.30 mol and more preferably from 0.01 to 0.20 mol per liter of the developer.

Specific examples of the compound shown by formula (I-4) are illustrated below but the invention is not limited to them.

(I-4)-1

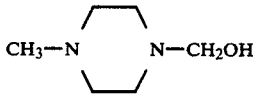

(I-4)-2

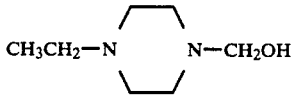

(I-4)-3

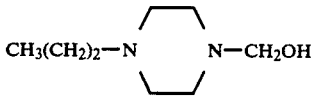

(I-4)-4

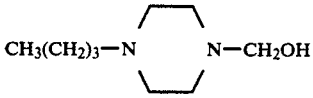

-continued
(I-4)-5
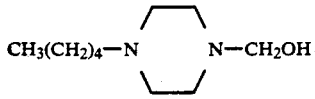
(I-4)-6
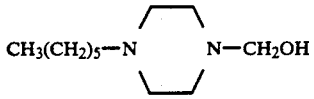
(I-4)-7
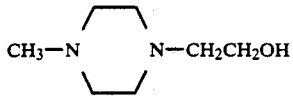
(I-4)-8
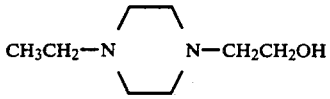
(I-4)-9
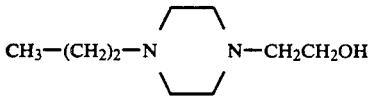
(I-4)-10
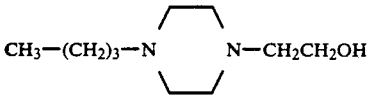
(I-4)-11
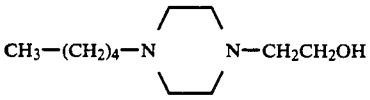
(I-4)-12
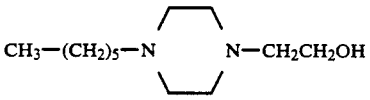
(I-4)-13
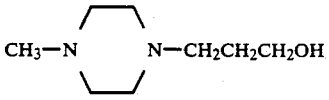
(I-4)-14
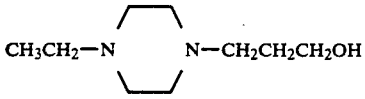
(I-4)-15
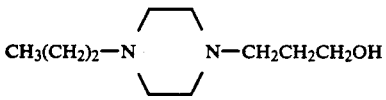
(I-4)-16
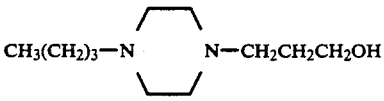
(I-4)-17
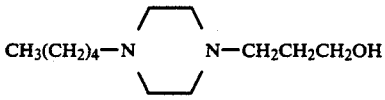
(I-4)-18
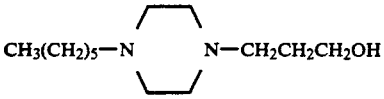
-continued
(I-4)-19
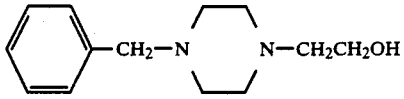
(I-4)-20
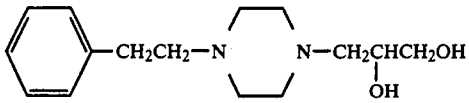
(I-4)-21
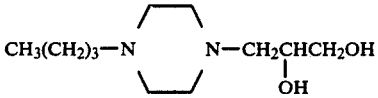
(I-4)-22
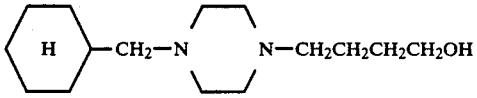
(I-4)-23
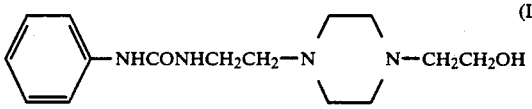
(I-4)-24
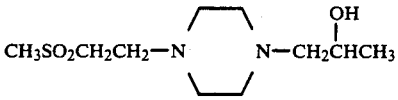
(I-4)-25
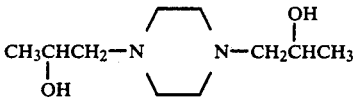
(I-4)-26
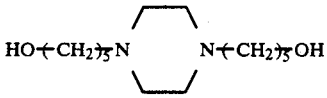
(I-4)-27
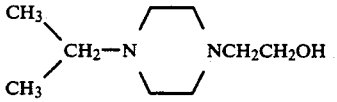
(I-4)-28
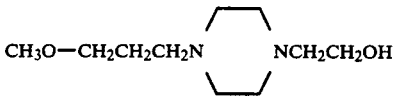
(I-4)-29
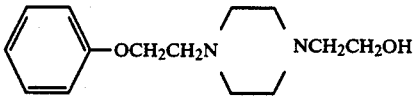
(I-4)-30
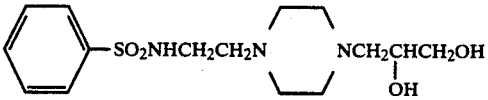
(I-4)-31
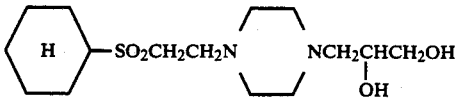
The compounds shown by formulae (I-1) to (I-4) described above are known compounds and the synthesis methods of them are also known.

The amino compounds shown by formulae (I-1) to (I-4) have a relatively low solubility in a developer (water) and when the volume of the developer containing the amino compound is reduced by concentrating it below the volume at use for the convenience of storage or transportation, it sometimes happens that the amino compound deposits and precipitates. Thus, it is preferred to use the amino compound together with a compound shown by following formula (B) or (C) for preventing the occurrence of the deposition and precipitation of the amino compound;

$F_{14}$—$SO_3M$ (tm)(B)

$R_{15}$—COOM (tm)(C)

wherein M represents hydrogen atom, Na, K, or $NH_4$; and $R_4$ and $R_{15}$ each represents an alkyl group having at least 3 carbon atoms, an alkylbenzene group, or a benzene group.

Specific examples of the compound shown by formula (B) are sodium p-toluenesulfonate, sodium benzenesulfonate, and sodium 1-hexanesulfonate.

Specific examples of the compound shown by formula (C) are sodium benzoate, sodium toluylate, potassium isobutyrate, sodium n-caproate, sodium n-caprylate, and sodium n-caprate.

The amount of the compound shown by formula (B) or (C) varies depending on the amount of the amino compound shown by formulae (I-1), (I-2), (I-3), or (I-4) but is usually at least 0.005 mol/liter and preferably from 0.03 mol/liter to 0.1 mol/liter. Also, the amount of the compound shown by formula (B) or (C) is generally from 0.5 to 20 mols per mol of the amino compound shown by formulae (I 1), (I-2), (I-3), or (I-4).

The pH value of the developer for use in this invention is selected in the range of from 10.0 to 12.3. As the alkali agent for adjusting the pH value, a watersoluble inorganic alkali metal salt (e.g., sodium hydroxide, sodium carbonate) is usually used.

The developer for use in this invention can further contain a pH buffer such as boric acid, borax, sodium tertiary phosphate, potassium tertiary phosphate, and those described in JP-A-60-93433 (the term "JP-A" as used herein means an "unexamined published Japanese patent application").

The developer may further contain a development inhibitor such as potassium bromide and potassium iodide; an organic solvent such as ethylene glycol, diethylene glycol, triethylene glycol, dimethylformamide, methyl cellosolve, hexylene glycol, ethanol, and methanol; and an antifoggant or a black pepper inhibitor such as indazole series compounds (e.g., 5-nitroindazole) and benztriazole series compounds (e.g., 5-methylbenztriazole).

In particular, in the case of using such a compound as 5-nitroindazole, the portion containing the compound is separately prepared in advance from a portion containing the dihydroxybenzene series developing agent and a sulfite preservative, and they are mixed with the addition of water at use. Furthermore, when the portion containing 5-nitroindazole is in an alkaline state, the solution is colored yellow, which is convenient for handling.

Furthermore, if necessary, the developer may contain a toning agent, a surface active agent, a water softener, a hardening agent, etc.

As a fix solution which is used in the process of this invention, a conventional composition can be used.

As a fixing agent, thiosulfates and thiocyanates as well as organic sulfur compounds which are known to have a function as a fixing agent can be used.

The fix solution may further contain a watersoluble aluminum salt such as aluminum sulfate and alum as a hardening agent. The content of the water-soluble aluminum salt is usually from 0 to 3.0 g-Al/liter.

Also, for the fix solution may be used an ethylenediaminetetraacetic acid Fe(III) complex salt as an oxidizing agent.

The processing temperature in this invention is usually selected from 18° C. to 50° C. but temperatures lower than 18° C. or higher than 50° C. may be employed as the case may be.

The process of this invention is particularly suitable for quick processing using an automatic processor. As the automatic processor, a roller conveying type, a belt conveying type, etc., can be employed.

The processing time may be short and the process of this invention gives a sufficient effect to quick processing wherein the total processing time is shorter than 2 minutes, particularly shorter than 100 seconds, and also the development time is from 15 seconds to 60 seconds.

A silver halide photographic material processed by the process of this invention preferably contains as a hydrazine derivative a compound represented by formula (III):

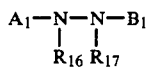

(III)

wherein $A_1$ represents an aliphatic group or an aromatic group; $B_1$ represents a formyl group, an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfinamoyl group, an alkoxysulfonyl group, a thioacyl group, a thiocarbamoyl group, a sulfanyl group, or a heterocyclic group; and $R_{16}$ and $R_{17}$ both represent hydrogen atom or one of them represents hydrogen atom and the other represents a substituted or unsubstituted alkylsulfonyl group, a substituted or unsubstituted arylsulfonyl group, or a substituted or unsubstituted acyl group, provided that $B_1$ may form a partial structure

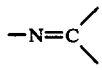

of the hydrazone together with $R_{16}$ and the nitrogen atom to which they bond.

Then, the compound shown by formula (III) is explained in detail.

The aliphatic group shown by $A_1$ in formula (III) is preferably a straight chain, branched, or cyclic alkyl group having preferably from 1 to 30 carbon atoms and more preferably from 1 to 20 carbon atoms. The branched alkyl group may be cyclized so as to form a saturated heterocyclic ring containing one or more hetero atoms. Also, the alkyl group may have a substituent such as an aryl group, an alkoxy group, a sulfoxy group, a sulfonamido group, and a carbonamido group.

Specific examples of the aliphatic group shown by $A_1$ are t-butyl, n-octyol, t-octyl, cyclohexyl, pyrrolidyl, imidazolyl, tetrahydrofuryl, and morpholino.

The aromatic group shown by $A_1$ in formula (III) is a monocyclic or bicyclic aryl group or an unsaturated heterocyclic group. The unsaturated heterocyclic group may be condensed with a monocyclic or bicyclic aryl group to form a heteroaryl group.

Examples of the aromatic group shown by $A_1$ are benzene ring, naphthalene ring, pyridine ring, pyrimidine ring, imidazole ring, pyrazole ring, quinoline ring, isoquinoline ring, benzimidazole ring, thiazole ring, and benzothiazole ring. Among rings, the rings containing benzene ring are preferred.

$A_1$ is particularly preferably an aryl group.

The aryl group or unsaturated heterocyclic group shown by $A_1$ may have a substituent. Typical examples of the substituent are a straight chain, branched, or cyclic alkyl group (preferably having from 1 to 20 carbon atoms), an aralkyl group (preferably a monocyclic or dicyclic aralkyl group the alkyl moiety of which has from 1 to 3 carbon atoms), an alkoxy group (preferably having from 1 to 20 carbon atoms), a substituted amino group (preferably an amino group substituted by an alkyl group having from 1 to 20 carbon atoms), an acylamino group (preferably having from 2 to 30 carbon atoms), a sulfonamido group (preferably having from 1 to 30 carbon atoms), and a ureido group (preferably having from 1 to 30 carbon atoms).

$A_1$ in formula (III) may contain therein a ballast group which is usually used for immobile photographic additives such as couplers. The ballast group is a group having at least 8 carbon atoms and being relatively inert to photographic properties and examples thereof are an alkyl group, an alkoxy group, a phenyl group, an alkylphenyl group, a phenoxy group, and an alkylphenoxy group.

Furthermore, $A_1$ in formula (III) may contain therein a group of strengthening the adsorption to the surface of silver halide grain. As such an adsorptive group, there are thiourea groups, heterocyclic thioamido groups, mercaptoheterocyclic groups, and triazole groups, described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-60-179734, JP-A-61-170733, and JP-A-62-948.

$B_1$ in formula (III) represents, practically, formyl group, an acyl group (e.g., acetyl, propionyl, trifluoroacetyl, chloroacetyl, benzoyl, 4-chlorobenzoyl, pyruvoyl, methoxalyl, methyloxamoyl), an alkylsulfonyl group (e.g., methanesulfonyl, 2-chloroethanesulfonyl), an arylsulfonyl group (e.g., benzenesulfonyl), an alkylsulfinyl group (e.g., methanesulfinyl), an arylsulfinyl group (e.g., benzenesulfinyl), a carbamoyl group (e.g., methylcarbamoyl, phenylcarbamoyl), a sulfamoyl group (e.g., dimethylsulfamoyl), an alkoxycarbonyl group (e.g., methoxycarbonyl, methoxyethoxycarbonyl), an aryloxycarbonyl group (e.g., phenoxycarbonyl), a sulfinamoyl group (e.g., methylsulfinamoyl), an alkoxysulfonyl group (e.g., methoxysulfonyl, ethoxysulfonyl), a thioacyl group (e.g., methylthiocarbonyl), a thiocarbamoyl group (e.g., methylthiocarbamoyl), or a heterocyclic group (e.g., pyridine).

$B_1$ is particularly preferably formyl group or an acyl group.

In formula (III), $B_1$ may form a partial structure

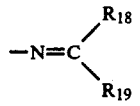

(wherein $R_{18}$ represents an alkyl group, an aryl group, or a heterocyclic group; and $R_{19}$ represents hydrogen atom, an alkyl group, an aryl group, or a heterocyclic group) together with $R_{17}$ and the nitrogen atom to which they bond.

In formula (III), $R_{16}$ and $R_{17}$ both represent hydrogen atom or one of them represents hydrogen atom and the other represents an alkylsulfonyl group or an arylsulfonyl group each having not more than 20 carbon atoms (preferably phenylsulfonyl group or a phenylsulfonyl group substituted such that the sum of the Hammett's substituent constants becomes at least −0.5), or an acyl group having not more than 20 carbon atoms [preferably benzoyl group, a benzoyl group substituted such that the sum of the Hammett's substituent constants becomes at least −0.5, or a straight chain, branched or cyclic, unsubstituted or substituted aliphatic acyl group (examples of the substituent are a halogen atom, an ether group, a sulfonamido group, a carbonamido group, hydroxyl group, a carboxyl group, and a sulfonic group)].

$R_{16}$ and $R_{17}$ in formula (III) are most preferably hydrogen atom.

Other hydrazine derivatives than the aforesaid ones, which can be also used for the photographic materials in this invention, are described in *Research Disclosure*, No. 23516, page 346 (November, 1983) and the literatures cited therein, U.S. Pat. Nos. 4,080,207, 4,269,929, 4,276,364, 4,278,748, 4,385,108, 4,459,347, 4,560,638, and 4,478,928, British Patent 2,011,391B, and JP-A-60-179734.

Then, the hydrazine derivatives shown by formula (III) described above are illustrated below but the invention is not limited to them.

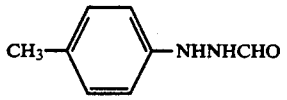

(III-1)

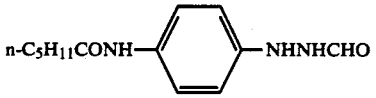

(III-2)

-continued
(III-3)
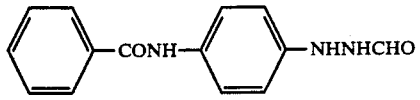
(III-4)
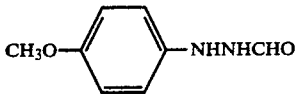
(III-5)
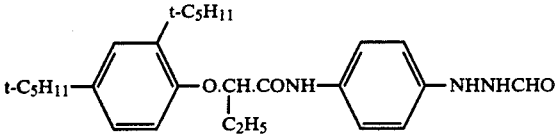
(III-6)
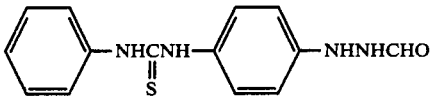
(III-7)
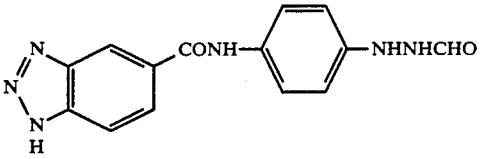
(III-8)
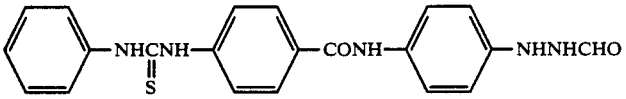
(III-9)
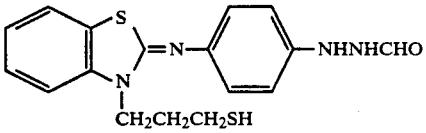
(III-10)
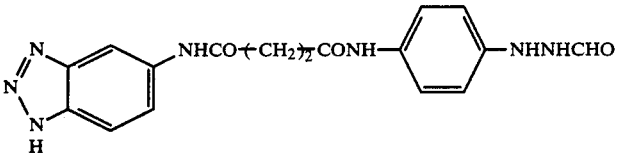
(III-11)
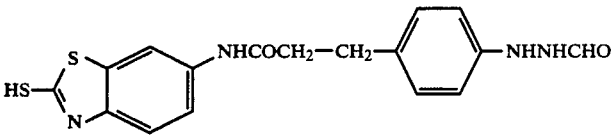
(III-12)
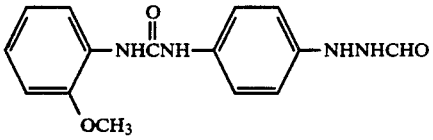
(III-13)
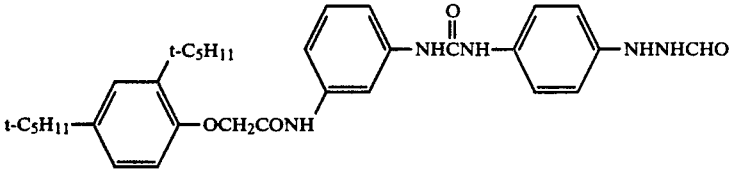

-continued
(III-14)
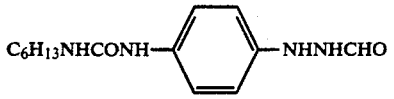
(III-15)
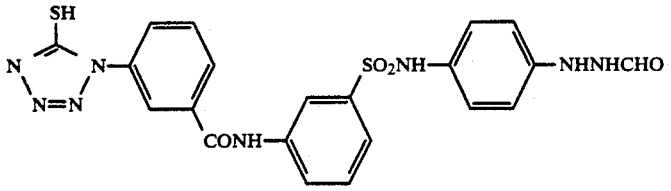
(III-16)
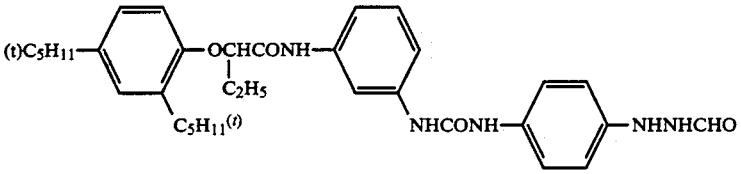
(III-17)
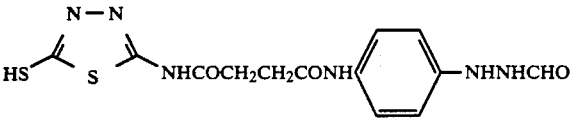
(III-18)
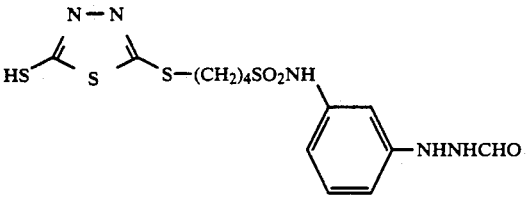
(III-19)
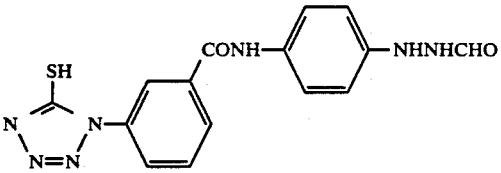
(III-20)
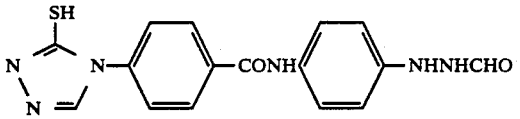
(III-21)
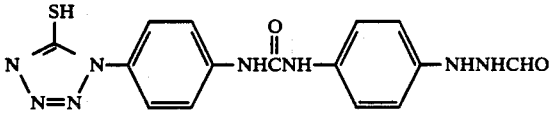
(III-22)
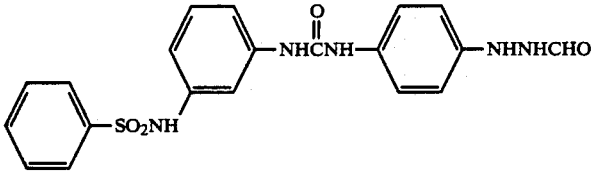
(III-23)
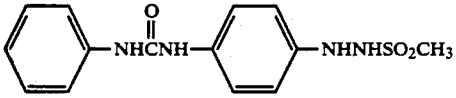

-continued (III-24)

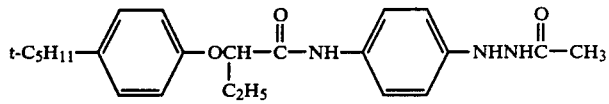

(III-25)

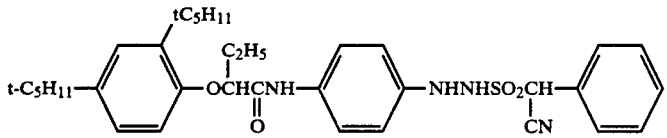

(III-26)

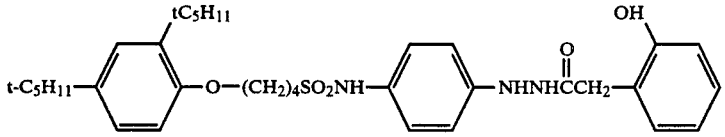

(III-27)

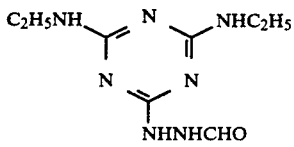

(III-28)

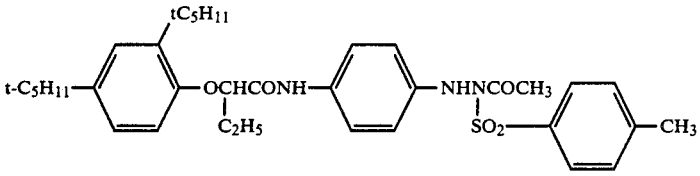

(III-29)

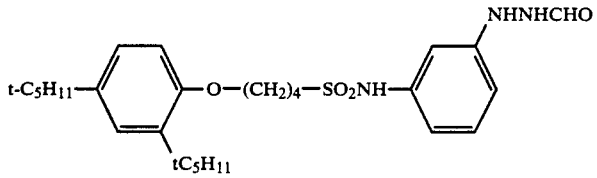

(III-30)

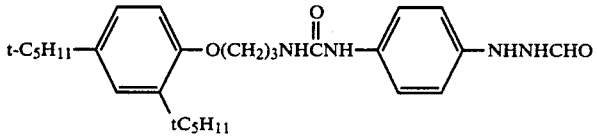

(III-31)

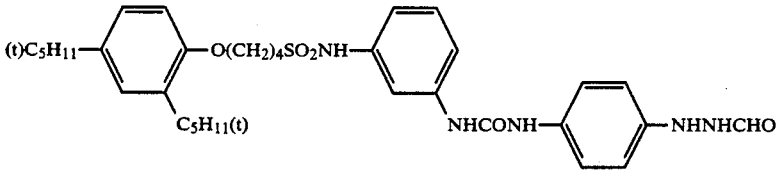

The aforesaid hydrazine derivative shown by formula (III) is incorporated in a silver halide photographic material in this invention and in this case, it is preferred that the hydrazine derivative is incorporated in the silver halide emulsion layer but it may exist in other light-insensitive hydrophilic colloid layer (e.g., protective layer, interlayer, filter layer, anti-halation layer).

Practically, when the hydrazine derivative is water-soluble, it may be added to an aqueous hydrophilic colloid solution as an aqueous solution, while when the derivative is sparingly soluble in water, it may be added to a hydrophilic colloid solution as a solution in an organic solvent miscible with water, such as alcohols, esters, and ketones.

When the hydrazine derivative is added to a silver halide emulsion layer, it may be added thereto at any desired time from the initiation of chemical ripening of the emulsion but before coating but is preferably added thereto from the end of chemical ripening but before coating. In particular, it is better to add the hydrazine derivative to a coating solution prepared for coating.

The amount of the hydrazine derivatives is preferably from $1\times10^{-6}$ to $1\times10^{-1}$ mol and more preferably from $1\times10^{-5}$ to $4\times10^{-3}$ mol per mol of silver.

The silver halide composition of the silver halide emulsion in this invention may be silver chloride, silver chlorobromide, silver iodobromide, silver iodochlorobromide, etc., but silver iodobromide is preferred. The content of silver iodide is preferably less than 10 mol% and particularly preferably from 0.1 to 3.5 mol%.

The mean grain size of the silver halide grains for use in this invention is preferably fine (e.g., less than 0.7 μm) and particularly preferably less than 0.5 μm. There is no fundamental restriction on the grain size distribution in this invention but a mono-dispersed emulsion is preferred. The term "mono-dispersed" means that at least 95% by weight or by grain number of the silver halide grains are within ±40% of the mean grain size.

The silver halide grains in the photographic emulsion may have a regular crystal form such as cubic, octahedral, tetradecahedral, and rhombic dodecahedral forms, and cubic form and octadecahedral form are particularly preferred. Also, the silver halide grains may have an irregular crystal form such as spherical form, plate-like form, tabular form having an aspect ratio of from 3 to 20, or a composite form of these crystal forms.

The silver halide grain may have a uniform phase between the inside and the surface layer thereof or may have a different layer between them. Also, a mixture of two or more kinds of silver halide emulsions separately prepared may be used.

During the formation or physical ripening of the silver halide grains, a cadmium salt, a sulfite, a lead salt, a thallium salt, a rhodium salt or a complex salt thereof, an iridium salt or a complex salt thereof, etc., may exist in the system.

The silver halide particularly suitable for this invention is silver halo-iodide prepared in the existence of from $10^{-3}$ to $10^{-5}$ mol of an iridium salt per mol of silver halide, wherein the silver iodide content at the surface of the grains is larger than the mean silver iodide content. By using a silver halide emulsion containing the aforesaid silver halo-iodide, photographic characteristics having higher sensitivity and high gamma are obtained.

In the aforesaid case, it is preferred to add the aforesaid amount of an iridium salt to the system before the end of physical ripening, in particular at the formation of silver halide grains in the production step of the silver halide emulsion.

The iridium salt for use in this case is a water-soluble iridium salt or iridium complex salt, such as, for example, iridium trichloride, iridium tetrachloride, potassium hexachloroiridate(III), potassium hexachloroiridate(IV), and ammonium hexachloroiridate(III).

The silver halide emulsion for use in this invention may not be chemically sensitized or may be chemically sensitized. As the chemical sensitization method, a sulfur sensitization, a reduction sensitization, a gold sensitization, etc., can be used solely or as a combination thereof. A preferred chemical sensitization is a sulfur sensitization.

For the sulfur sensitization, a sulfur compound contained in gelatin as well as various sulfur compounds such as thiosulfates, thioureas, thiazoles, and rhodanines can be used. Specific examples are described in U.S. Pat. Nos. 1,574,944, 2,278,947, 2,410,689, 2,728,668, 3,501,313, and 3,656,955.

Preferred sulfur compounds are thiosulfates and thiourea compounds and pAg at the chemical sensitization is in the range of preferably not more than 8.3 and more preferably from 7.3 to 8.0.

Furthermore, the method of using a combination of polyvinylpyrrolidone and a thiosulfate as described in Moisar and Klein, *Gelatin Proc. Symp.* 2nd, 301-309 (1970) gives good result.

A typical noble metal sensitization method is a gold sensitization method and as a gold compound, a gold complex salt is mainly used. In the noble metal sensitization, complex salts of other noble metals than gold, such as platinum, palladium, and iridium may be used. Specific examples thereof are described in U.S. Pat. No. 2,448,060 and British Patent 618,061.

For the reduction sensitization method, stannous salts, amines, formamidinesulfinic acid, silane compounds, etc., can be used. Specific examples thereof are described in U.S. Pat. Nos. 2,487,850, 2,518,698, 2,983,609, 2,983,610, and 2,694,637.

For the silver halide photographic materials for use in this invention, one kind of silver halide emulsion may be used or a mixture of two or more kinds of emulsions having different mean grain sizes, different halogen compositions, different crystal habits, or being differ in chemical sensitizing conditions.

In the case of using two or more kinds of silver halide emulsions, the use of two kinds of mono-dispersed emulsions each having different mean grain size as disclosed in JP-A-61-223734 and JP-A-62-90646 is preferred in the point of increasing the maximum density (Dmax). In this case, it is preferred that the monodispersed silver halide emulsion of smaller grain sizes is chemically sensitized and as the chemical sensitization a sulfur sensitization is most preferred. The mono-dispersed silver halide emulsion of larger grain sizes is not chemically sensitized since the emulsion is liable to cause black pepper, or if the emulsion is chemically sensitized, it is particularly preferred to apply the chemical sensitization shallowly to an extent of not causing black pepper. In this case, the term "shallowly apply" means that the time of applying the chemical sensitization is shortened as compared to the chemical sensitization for the monodispersed emulsion of smaller grain sizes or the chemical sensitization is performed at a lower temperature or with a reduced amount of a chemical sensitizer. There is no particular restriction on the sensitivity difference between the larger grain size mono-dispersed emulsion and the smaller grain size monodispersed emulsion but the difference is preferably from 0.1 to 1.0 and more preferably from 0.2 to 0.7 as ΔlogE, and also it is preferred that the sensitivity of the larger size mono-dispersed emulsion is higher.

Also, the silver halide emulsion layer in this invention may be a single layer or multilayer (double layer or triple layer). In the case of multilayer, each layer may be composed of each different silver halide emulsion or all layers may be composed of the same kind of silver halide emulsion.

As a binder or protective colloid for the silver halide emulsions, gelatin is advantageously used but other hydrophilic colloids can be used. For example, there are proteins such as gelatin derivatives, graft polymers of gelatin and other polymers, alubmin, and casein; cellulose derivatives such as hydroxyethyl cellulose, carboxymethyl cellulose, and cellulose sulfate ester; saccharide derivatives such as sodium alginate and starch derivatives; and various kinds of synthetic hydrophilic polymers such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole.

As gelatin, limed gelatin or acid-treated gelatin may be used and further gelatin hydrolyzed product or an enzyme decomposition product of gelatin can be used.

The silver halide emulsion for use in this invention can further contain a sensitizing dye (e.g., cyanine dye, merocyanine dye) having the absorption maximum in a visible region described in JP-A-55-52050, pages 45–53, whereby the emulsion can be spectrally sensitized at a longer wavelength side than the intrinsic sensitivity region of the silver halide.

The sensitizing dyes can be used singly or as a combination of them and a combination of sensitizing dyes is frequently used for the purpose of supersensitization. The silver halide emulsion may also contain a dye having no spectral sensitizing action by itself or a material which does not substantially absorb visible light but shows supersensitization together with a sensitizing dye.

Useful sensitizing dyes, combinations of dyes showing supersensitization, and materials showing supersensitization are described in *Research Disclosure,* Vol. 176, No. 17643, page 23, IV-J (December, 1978).

The photographic light-sensitive materials for use in this invention can contain various compounds for inhibiting the formation of fog during the production, storage and processing of the photographic materials and/or stabilizing the photographic performance. That is, there are various compounds known as antifoggants or stabilizers, such as azoles (e.g., benzothiazoliums, nitroindazoles, chlorobenzimidazoles, bromobenzimidazoles, mercaptotetrazoles, mercaptothiazoles, mercaptobenzothiazoles, mercaptothiadiazoles, aminotriazoles, benzothiazoles, nitrobenzotriazoles), mercaptopyrimidines, mercaptotriazines, thioketo compounds (e.g., oxazolinethione), azaindenes (e.g., triazaindenes, tetraazaindenes (in particular, 4-hydroxy-substituted (1,3,3*a*,7)-tetraazaindenes), pentaazaindenes), benzenethiosulfonic acid, benzenesulfinic acid, and benzenesulfonic acid amide Among these compounds, benzotriazoles (e.g., 5-methylbenzotriazole) and nitroindazoles (e.g., 5-nitroindazole) are preferred. Also, the aforesaid compound may be added to a processing solution.

Furthermore, the photographic light-sensitive materials may contain a compound capable of releasing an inhibitor during development as a stabilizer or for inhibiting the formation of black pepper.

The photographic light-sensitive material for use in this invention can contain a developing agent such as hydroquinone derivatives and phenidone derivatives as a stabilizer, an accelerator, etc.

Furthermore, the photographic light-sensitive material for use in this invention may contain an inorganic or organic hardening agent in the photographic emulsion layer(s) and other hydrophilic colloid layer(s). Examples of the hardening agent are chromium salts (e.g., chromium alum, chromium acetate), aldehydes (e.g., formaldehyde, glutaraldehyde), N-methylol compounds (e.g., dimethylolurea), dioxane derivatives, active vinyl compounds (e.g., 1,3,5-triacryloylhexahydro-s-triazine, 1,3-vinylsulfonyl-2-propanol), active halogen compounds (e.g., 2,4-dichloro-6-hydroxys triazine), and mucohalogenic acids (e.g., mucochloric acid). They can be used singly or as a mixture thereof.

Moreover, the photographic light-sensitive materials for use in this invention may further contain various kinds of surface active agents in the photographic emulsion layers or other hydrophilic colloid layers for various purposes such as coating aid, static prevention, improvement of slidability, emulsified dispersion, sticking prevention, and improvement of photographic properties (e.g., development acceleration, contrast increase, and sensitization).

Examples of the surface active agents are nonionic surface active agents such as saponin (steroid series), alkylene oxide derivatives (e.g., polyethylene glycol, polyethylene glycol/polypropylene glycol condensates, polyethylene glycol alkyl ethers, polyethylene glycol alkylaryl ethers, polyethylene glycol esters, polyethylene sorbitan esters, polyalkylene glycol alkylamines, polyalkylene glycol alkylamides, polyethylene oxide addition products of silicone), glycidol derivatives (e.g., alkenylsuccinic acid polyglycerides, alkylphenol polyglycerides), and alkyl esters (e.g., fatty acid esters of polyhydric alcohols); anionic surface active agents having an acid group (e.g., carboxyl group, sulfo group, phospho group, sulfate group, phosphorate group), such as alkylcarboxylates, alkylsulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkyl polyoxyethylene alkylphenyl ethers and polyoxyethylene alkylphosphoric acid esters; an amphoteric surface active agents such as amino acids, aminoalkylsulfonic acids, aminoalkylsulfuric acid esters, aminoalkylphosphoric acid esters, alkylbetaines, and amine oxides; and cationic surface active agents such as alkylamines, aliphatic or aromatic quaternary ammonium salts, heterocyclic quaternary ammonium salts (e.g., pyridiniums, imidazoliums), and phosphinium or sulfonium salts containing an aliphatic or aromatic ring.

The particularly preferred surface active agents in this invention are polyalkylene oxides having a molecular weight of at least 600 described in JP-B-589412. (The term "JP-B" as used herein means an "examined published Japanese patent application").

Also, the fluorine-containing surface active agents described in JP-A-60-80849 can be preferably used for static prevention.

The photographic light-sensitive materials for use in this invention may further contain a hydroquinone derivative releasing a development inhibitor corresponding to the density of images at development (so-called DIR hydroquinone) in the photographic emulsion layers or other hydrophilic colloid layers. Specific examples of these hydroquinone derivatives are described in U.S. Pat. Nos. 3,379,529, 3,620,746, 4,377,634, and 4,332,878, JP-A-49-129536, JP-A-54-67419, JP-A-56-153336, JP-A-56- o 153342, JP-A-59-278853, JP-A-59-90435, JP-A-59-90436, and JP-A-59-138808.

Also, the photographic light-sensitive materials for use in this invention can further contain a matting agent such as magnesium oxide and polymethyl methacrylate, in the photographic emulsion layers or other hydrophilic colloid layers for the purpose of sticking prevention.

Moreover, the photographic light-sensitive materials for use in this invention can further contain a dispersion of a water-insoluble or water sparingly soluble synthetic polymer for the purpose of improving dimensional stability of the photographic materials. Examples of the polymers are polymers of alkyl (meth)acrylates or alkoxyalkyl (meth)acrylates solely or as a combination thereof, or a combination of the aforesaid monomer and acrylic acid, methacrylic acid, etc.

It is preferred that the photographic lightsensitive materials for use in this invention contain a compound having an acid group in the silver halide emulsion layers and other hydrophilic colloid layers. As the compound having an acid group, there are organic acids such as salicylic acid, acetic acid, and ascorbic acid and polymers and copolymers having an acid monomer such as acrylic acid, maleic acid, and phthalic acid, as the recurring unit. These compounds are described in JP-A-61-223834, JP-A-61-228437, JP-A-62-25745, and JP-A62-55642.

In the aforesaid compounds, ascorbic acid is particularly preferred as the low-molecular weight compound and a water dispersing latex of a copolymer composed of an acid monomer such as ascorbic acid and a cross-linking monomer having two or more unsaturated groups such as divinylbenzene is particularly preferred as the high-molecular weight compound The photographic light-sensitive material for use in this invention is prepared by coating the aforesaid silver halide emulsion(s) and other hydrophilic colloid compositions on a proper support such as a glass sheet, a cellulose acetate film, a polyethylene terephthalate film, a paper, a barytacoated paper, and a paper coated with polyolefin.

Then, the invention is described in more detail by the following examples

EXAMPLE 1

To a cubic silver iodobromide emulsion containing 2.5 mol% silver iodide and having a mean grain size of 0.3 μm were added 230 mg/mol-silver of anhydro-5,5-dichloro-9-ethyl-3,3'-bis(3-sulfopropyl)oxacarbocyanine hydroxide sodium salt (sensitizing dye), 1.3 g/mol-silver of a hydrazine derivative (Compound III-5), and 300 mg/mol-silver of polyethylene glycol having a molecular weight of about 1000 and further 5-methylbenztriazole, 4-hydroxy-6-methyl-1,3,3a,7-tetraazaindene, a dispersion of polyethyl acrylate, and 2-hydroxy-1,3,5-triazine sodium salt were added to the emulsion mixture to provide a coating composition.

The coating composition thus prepared was coated on a polyethylene terephthalate film support at a silver coverage of 4.0 g/m$^2$ and a gelatin coverage of 2.5 g/m$^2$ to provide Film F.

The Film F was exposed through a sensitometric exposure wedge using a 150-line magenta contact screen, developed by a developer having the composition shown below for 30 seconds at 34° C., fixed, washed, and dried (using an automatic processor FG660F, made by Fuji Photo Film Co., Ltd.).

| Developer Composition (addition amount per liter of the developer) | |
|---|---|
| Hydroquinone | 50.0 g |
| N-Methyl-p-aminophenol ½$H_2SO_4$ | 0.3 g |
| Sodium Hydroxide | 18.0 g |
| 5-Sulfosalicylic Acid | 55.0 g |
| Potassium Sulfite | 110.0 g |
| Disodium Ethylenediaminetetraacetate | 1.0 g |
| Potassium Bromide | 10.0 g |
| 5-Methylbenztriazole | 0.4 g |
| 2-Mercaptobenzimidazole-5-sulfonic Acid | 0.2 g |

-continued

| Developer Composition (addition amount per liter of the developer) | |
|---|---|
| Sodium 3-(5-Mercaptotetrazole)benzenesulfonate | 0.2 g |
| Sodium Toluenesulfonate | 8.0 g |
| Water to make | 1 liter |
| pH adjusted to 11.8 by adding potassium hydroxide. | |

The photographic performance in each case of developing Film F with a fresh developer having the aforesaid composition further added with each of the amino compounds (I-1), (I-1)-2, and (I-1)-3 in this invention and the comparison compounds (Z)-1 and (Z)-2 described in U.S. Pat. No. 4,269,929 and also the photographic performance and the extent of silver stain in each case of running processing Film F for 5 days per 200 films a day while replenishing 100 ml of each developer with every processing of one film of large area (50.8 cm×61.0 cm) a half area of which was subjected to overall exposure are shown in Table 1 below.

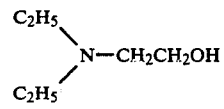

(Z)-1

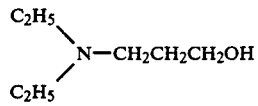

(Z)-2

In Table 1, the sensitivity is a relative value when the reciprocal of the exposure amount required for obtaining density 1.5 in the case of processing Film F with the developer of Experiment No. 3 is defined as 100.

Also, $\overline{G}$ shows tan $\theta$ of the line of connecting the points of 0.3 and 3.0 in density on the characteristic curve. In the case of a silver halide photographic material suitable for photomechanical process for printing in graphic arts, it is preferred that the value of $\overline{G}$ is at least 10.

The dot quality in Table 1 is evaluated visually in 5 grades, wherein grade 5 shows the best quality and grade 1 shows the worst quality. As a printing plate making dot plate, dot qualities of grades 5 and 4 are practically usable quality, the dot quality of grade 3 is not so good but a lowest practically usable quality, and dot images of grades 2 and 1 are unsuitable for practical use.

The silver stain in Table 1 is evaluated in 5 grades, wherein the state having no silver stain on the film of 9.0 cm×25.0 cm is evaluated as grade 5 and the state of forming silver stain on the whole surface of the film is evaluated as grade 1. Grade 4 is a state of very slightly forming silver stain on the film, which is an allowable level for practical use but grades 3 and lower are unsuitable for practical use.

The results are shown in Table 1.

TABLE 1

| Experiment No. | Amino Compound | Amount of Amino Compound (mol/liter) | Photographic Performance by Fresh Developer | | | Photographic Performance by Running Processing | | | |
|---|---|---|---|---|---|---|---|---|---|
| | | | Sensitivity | $\overline{G}$ | Dot Quality | Sensitivity | $\overline{G}$ | Dot Quality | Silver Stain |
| 1 | — | — | 30 | 3 | 1 | 30 | 3 | 1 | 5 |
| 2 | (I-1)-1 | 0.02 | 90 | 15 | 5 | 90 | 15 | 5 | 5 |
| 3 | (I-1)-2 | 0.02 | 100 | 15 | 5 | 100 | 15 | 5 | 5 |
| 4 | (I-1)-3 | 0.02 | 100 | 15 | 5 | 100 | 15 | 5 | 5 |

TABLE 1-continued

| Experiment No. | Amino Compound | Amount of Amino Compound (mol/liter) | Photographic Performance by Fresh Developer | | | Photographic Performance by Running Processing | | | |
|---|---|---|---|---|---|---|---|---|---|
| | | | Sensitivity | $\overline{G}$ | Dot Quality | Sensitivity | $\overline{G}$ | Dot Quality | Silver Stain |
| 5 | (Z)-1 | 0.02 | 70 | 8 | 2 | 70 | 8 | 2 | 4.5 |
| 6 | (Z)-1 | 0.08 | 100 | 14 | 5 | 100 | 14 | 5 | 3 |
| 7 | (Z)-2 | 0.02 | 50 | 5 | 2 | 50 | 5 | 2 | 4.5 |
| 8 | (Z)-2 | 0.08 | 100 | 15 | 5 | 100 | 15 | 5 | 3 |

As is clear from the results shown in Table 1, it can be seen that in the case of not using the amino compound in this invention for the developer as in Experiment No. 1, a satisfactory photographic performance is not obtained but when the amino compounds are used as in Experiment Nos. 2, 3, and 4, the sensitivity, $\overline{G}$, and the dot quality are improved.

On the other hand, when other comparison amino compounds are used in the same amount as the amount of the amino compound in this invention as in Experiment Nos. 5 and 7, the formation of silver stain is almost satisfactorily less but the sensitivity, G, and the dot quality are unsatisfactory. Furthermore, when the amount of the comparison amino compound is increased, the photographic performance is improved but the formation of silver stain becomes severe to make the quality unsuitable for practical use as in Experiment Nos. 6 and 8.

EXAMPLE 2

The same procedure as in Example 1 was followed using Film F as in Example 1, except for using a developer having the composition as shown below.

| Developer Composition (the amount per liter of the developer) | |
|---|---|
| Hydroquinone | 50.0 g |
| N-Methyl-p-aminophenol $\frac{1}{2}H_2O$ | 0.3 g |
| Sodium Hydroxide | 18.0 g |
| Boric Acid | 54.0 g |
| Potassium Sulfite | 110.0 g |
| Disodium Ethylenediaminetetraacetate | 1.0 g |
| Potassium Bromide | 10.0 g |
| 5-Methylbenztriazole | 0.4 g |
| 2-Mercaptobenzimidazole-5-sulfonic Acid | 0.2 g |
| Sodium 3-(5-Mercaptotetrazole)benzene-sulfonate | 0.2 g |
| Sodium Toluenesulfonate | 8.0 g |
| Water to make | 1 liter |
| pH adjusted to 11.8 by the addition of potassium hydroxide. | |

The photographic performance in each case of developing the sample film with a fresh developer having the aforesaid composition further added with each of the amino compounds (I-2), (I-2), and (I-2)-9 in this invention and the comparison compound (Z)-3 described in U.S. Pat. No. 4,269,929 and also the photographic performance and the extent of silver stain in each case of running processing the sample film for 5 days per 200 films a day while replenishing 100 ml of each developer with every processing of one film of large size (50.8 cm×61.0 cm) a half area of which was subjected to overall exposure are shown in Table 2 below. The kind of the automatic processor and the development temperature and time were the same as in Example 1.

$H_2N\text{-}CH_2CH_2NH_2$(tm) (2)-3

TABLE 2

| Experiment No. | Amino Compound | Amount of Amino Compound (mol/liter) | Photographic Performance by Fresh Developer | | | Photographic Performance by Running Processing | | | |
|---|---|---|---|---|---|---|---|---|---|
| | | | Sensitivity | $\overline{G}$ | Dot Quality | Sensitivity | $\overline{G}$ | Dot Quality | Silver Stain |
| 11 | — | — | 30 | 3 | 1 | 30 | 3 | 1 | 5 |
| 12 | (I-2)-1 | 0.02 | 90 | 15 | 5 | 90 | 15 | 5 | 5 |
| 13 | (I-2)-6 | 0.02 | 100 | 15 | 5 | 100 | 15 | 5 | 5 |
| 14 | (I-2)-9 | 0.02 | 110 | 15 | 5 | 110 | 15 | 5 | 5 |
| 15 | (Z)-3 | 0.02 | 50 | 8 | 2 | 50 | 8 | 2 | 4 |
| 16 | (Z)-3 | 0.08 | 100 | 10 | 3 | 100 | 10 | 3 | 3 |

As is clear from the results shown in Table 2, when the amino compound in this invention is not used in Experiment No. 11, a satisfactory photographic performance is not obtained but when the amino compounds are used as in Experiment Nos. 12, 13, and 14, the sensitivity, $\overline{G}$, and the dot quality are improved.

On the other hand, when the comparison amino compound is used in the same amount as that of the amino compound in this invention as in Experiment No. 15, the formation of silver stain is almost satisfactorily less but the sensitivity, $\overline{G}$, and the dot quality are unsatisfactory. Furthermore, when the amount of the comparison compound is increased, the photographic performance is slightly improved but the formation of silver stain becomes severe to make the quality unsuitable for practical use.

EXAMPLE 3

A photographic light-sensitive film prepared by the same manner as in Example 1 was exposed through a sensitometric light exposure wedge using a 150-line magenta contact screen, developed by the developer as used in Example 1 for 30 seconds at 34° C., fixed, washed, and dried. For the processing, an automatic processor FG660 F (made by Fuji Photo Film Co., Ltd.) was used.

The photographic performance in each case of developing the sample film with the fresh developer described above further added with each of the amino compounds (I-3}-1, (I-3)-2, and (I-3) in this invention and the comparison amino compounds (Z)-1, (Z)-2 described in Example 1 and (Z)-4 shown below and also the photographic performance and the extent of silver stain in each case of running processing the sample film for 5 days per 200 films a day while replenishing 100 ml of each developer with every processing of one film of large size (50.8 cmx61.0 cm)a half area of which was subjected to overall exposure are shown in Table 3.

(Z)-4

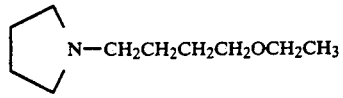

(described in JP-A-60-218642)

TABLE 3

| Experiment No. | Amino Compound | Amount of Amino Compound (mol/liter) | Photographic Performance by Fresh Developer: Sensitivity | $\overline{G}$ | Dot Quality | Photographic Performance by Running Processing: Sensitivity | $\overline{G}$ | Dot Quality | Silver Stain |
|---|---|---|---|---|---|---|---|---|---|
| 21 | — | — | 30 | 3 | 1 | 30 | 3 | 1 | 5 |
| 22 | (I-3)-1 | 0.02 | 90 | 15 | 5 | 90 | 15 | 5 | 5 |
| 23 | (I-3)-2 | 0.02 | 100 | 15 | 5 | 100 | 15 | 5 | 5 |
| 24 | (I-3)-6 | 0.02 | 100 | 15 | 5 | 100 | 15 | 5 | 5 |
| 25 | (Z)-1 | 0.02 | 70 | 8 | 2 | 70 | 8 | 2 | 4.5 |
| 26 | (Z)-1 | 0.08 | 100 | 14 | 5 | 100 | 14 | 5 | 3 |
| 27 | (Z)-2 | 0.02 | 50 | 5 | 2 | 50 | 5 | 2 | 4.5 |
| 28 | (Z)-2 | 0.08 | 100 | 15 | 5 | 100 | 15 | 5 | 3 |
| 29 | (Z)-4 | 0.08 | 70 | 8 | 2 | 70 | 8 | 2 | 4.5 |

As is clear from the results shown in Table 3, when the amino compound in this invention is not used in Experiment No. 21, a satisfactory photographic performance is not obtained but when the amino compounds in this invention are used as in Experiment Nos. 22, 23, and 24, the sensitivity, $\overline{G}$, and the dot quality are improved.

On the other hand, when the comparison amino compound is used in the same amount as that of the amino compound in this invention as in Experiment Nos. 25 and 27, the formation of silver stain is almost satisfactorily less but the sensitivity, G, and the dot quality are unsatisfactory. Furthermore, when the amount of the comparison compound is increased, the photographic properties are improved but the formation of silver stain becomes severe to make the quality unsuitable for practical use as in Experiment Nos. 26 and 28. Also, in Experiment No. 29, silver stain is improved but the sensitivity, G, and the dot quality are unsatisfactory.

EXAMPLE 4

A photographic light-sensitive film prepared as in Example 1 was exposed through a sensitometric exposure wedge using a 150-line contact screen, developed by the developer as in Example 1 for 30 seconds at 34° C., fixed, washed, and dried. For the processing, an automatic processor FG660F (made by Fuji Photo Film Co., Ltd.) was used.

The photographic performance in each case of developing the sample film with fresh developer described above further added with each of the amino compounds (I-4)-8, (I-4)-9, and (I-4)-10 in this invention and the comparison amino compounds (Z)-1 described in Example 1 and (Z)-5 shown below and also the photographic performance and the extent of silver stain in each case of running processing the sample film for 5 days per 200 films a day while replenishing 100 ml of each developer with every processing of one film of large size (50.8 cm×61.0 cm) a half area of which was subjected to overall exposure are shown in Table 4.

(Z)-5

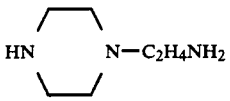

(β-(2-aminoethyl)piperazine)

TABLE 4

| Experiment No. | Amino Compound | Amount of Amino Compound (mol/liter) | Photographic Performance by Fresh Developer: Sensitivity | $\overline{G}$ | Dot Quality | Photographic Performance by Running Processing: Sensitivity | $\overline{G}$ | Dot Quality | Silver Stain |
|---|---|---|---|---|---|---|---|---|---|
| 31 | — | — | 30 | 3 | 1 | 30 | 3 | 1 | 5 |
| 32 | (I-4)-8 | 0.02 | 90 | 15 | 5 | 90 | 15 | 5 | 5 |
| 33 | (I-4)-9 | 0.02 | 100 | 15 | 5 | 100 | 15 | 5 | 5 |
| 34 | (I-4)-10 | 0.02 | 110 | 15 | 5 | 110 | 15 | 5 | 5 |
| 35 | (Z)-1 | 0.02 | 70 | 8 | 2 | 70 | 8 | 2 | 4.5 |
| 36 | (Z)-1 | 0.08 | 100 | 14 | 5 | 100 | 14 | 5 | 3 |
| 37 | (Z)-5 | 0.02 | 50 | 5 | 2 | 50 | 5 | 2 | 3 |
| 38 | (Z)-5 | 0.08 | 100 | 15 | 3 | 100 | 15 | 3 | 1 |

As is clear from the results shown in Table 4, when the amino compound in this invention is not used in Experiment No. 31, a satisfactory photographic performance is not obtained but when the amino compounds in this invention are used as in Experiment Nos. 32, 33, and 34, the sensitivity, $\overline{G}$, and the dot quality are improved.

On the other hand, when the comparison amino compound is used in the same amount as that of the amino compound in this invention as in Experiment Nos. 35 and 37, the formation of silver stain is almost satisfactorily less but the sensitivity, $\overline{G}$, and the dot quality are unsatisfactory. Furthermore, when the amount of the comparison compound is increased, the photographic properties is improved but the formation of silver stain becomes severe to make the quality unsuitable for practical use as in Experiment Nos. 36 and 38.

While the invention has been described in detail and with reference to specific embodiments thereof, it will be apparent to one skilled in the art that various changes and modifications can be made therein without departing from the spirit and scope thereof.

What is claimed is:

1. A high-contrast development process which comprises subjecting a silver halide photographic material to light and developing the exposed silver halide photographic material containing at least a hydrazine derivative with a developer having a pH of from 10.0 to 12.3 and containing:

(a) a dihydroxybenzene developing agent;

(b) at least 0.3 mol/liter of a sulfite, and (c) at least one of the compounds represented by formulae (I-1), (I-2), (I-3), or (I-4);

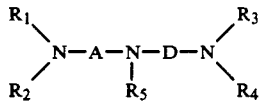

(I-1)

wherein $R_1$, $R_2$, $R_3$, $R_4$, $R_5$ each represents an alkyl goup having from 1 to 5 carbon atoms or a hydroxyalkyl group, provided that $R_1$ and $R_2$, or $R_3$ and $R_4$ may combine with each other to form a nitrogen-containing heterocyclic ring; and A and D each represents a substituted or unsubstituted alkylene group;

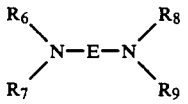

(I-2)

wherein $R_6$, $R_7$, $r_8$, and $R_9$ each represents an alkyl group having from 1 to 5 carbon atoms or a hydroxyalkyl group, provided that the $R_6$ and $R_7$, or $R_8$ and $R_9$ may combine with each other to form a nitrogen-containing heterocyclic ring, and E represents a substituted or unsubstituted alkylene group,

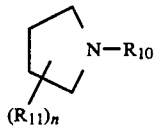

(I-3)

wherein $R_{10}$ represents a hydroxyalkyl group; $R_{11}$ represents a hydrogen atom or an alkyl group; and n represents an integer of from 0 to 3, and

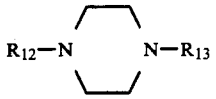

(I-4)

wherein $R_{12}$ represents an unsubstituted alkyl group and $R_{13}$ represents a hydroxyalkyl group.

2. The high-contrast development process as claimed in claim 1, wherein the silver halide photographic material is a photographic light-sensitive film for photomechanical printing plate making process.

3. The high-contrast development process as claimed in claim 1, wherein the hydrazine derivative is represented by formula (III)

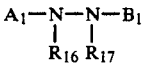

(III)

wherein $A_1$ represents an aliphatic group or an aromatic group; $B_1$ represents a formyl group, an acyl group, an alkylsulfonyl group, an arylsulfonyl group, an alkylsulfinyl group, an arylsulfinyl group, a carbamoyl group, an alkoxycarbonyl grup, an aryloxycarbonyl group, a sulfinamoyl group, an alkoxysulfonyl group, a thioacyl group, a thiocarbamoyl group, a sulfanyl group, or a heterocyclic group; and $R_{16}$ and $R_{17}$ both represent hydrogen atom or one of them represents hydrogen atom and the other represents a substituted or unsubstituted alkylsulfonyl group, a substituted or unsubstituted arylsulfonyl group, or a substituted or unsubstituted acyl group, provided that $B_1$ may form a partial structure

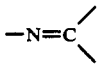

of the hydrazine together with $R_{16}$ and the nitrogen atom to which they are bonded.

* * * * *